US011905679B2

(12) United States Patent
Mathivanan et al.

(10) Patent No.: US 11,905,679 B2
(45) Date of Patent: Feb. 20, 2024

(54) MACHINE AND METHOD OF MOVING UPPER STRUCTURE OF MACHINE

(71) Applicant: Caterpillar Global Mining Equipment LLC, Denison, TX (US)

(72) Inventors: Saravanan S. Mathivanan, Chennai (IN); Sridhar Thondikulam Raveendran, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 267 days.

(21) Appl. No.: 17/109,308

(22) Filed: Dec. 2, 2020

(65) Prior Publication Data

US 2021/0164195 A1 Jun. 3, 2021

(30) Foreign Application Priority Data

Dec. 2, 2019 (IN) ..... 201911049406

(51) Int. Cl.
*E02F 9/20* (2006.01)
*E02F 9/16* (2006.01)
*E02F 9/26* (2006.01)

(52) U.S. Cl.
CPC ..... *E02F 9/2033* (2013.01); *E02F 9/166* (2013.01); *E02F 9/26* (2013.01)

(58) Field of Classification Search
CPC . E02F 9/166; E02F 9/2033; E02F 9/26; E02F 9/028; E02F 9/2004; E21B 7/024
See application file for complete search history.

(56) References Cited

U.S. PATENT DOCUMENTS

| | | | | |
|---|---|---|---|---|
| 5,806,616 | A | 9/1998 | Enlund et al. | |
| 6,467,557 | B1 | 10/2002 | Krueger et al. | |
| 7,438,143 | B2 * | 10/2008 | Law | E21B 7/024 180/41 |
| 8,205,164 | B2 * | 6/2012 | Kim | G01C 9/06 715/764 |
| 8,485,288 | B2 | 7/2013 | Kaethner et al. | |
| 8,594,879 | B2 | 11/2013 | Roberge et al. | |
| 9,663,921 | B2 | 5/2017 | Wei et al. | |
| 2009/0118913 | A1 * | 5/2009 | O'Halloran | E02F 9/028 701/50 |

(Continued)

FOREIGN PATENT DOCUMENTS

| | | |
|---|---|---|
| CN | 106522834 B | 10/2018 |
| CN | 109667539 A | 4/2019 |

*Primary Examiner* — Tyler J Lee
*Assistant Examiner* — Yufeng Zhang

(57) ABSTRACT

A machine operating on a work surface includes a boom member, a feed assembly, a work device, a movable carrier including a lower structure and an upper structure movably coupled with the lower structure, and an actuator assembly adapted to move the upper structure relative to the lower structure. The machine also includes a sensor module configured to generate a first signal indicative of a first pitch angle. The machine further includes a control module configured to receive the first signal indicative of the first pitch angle. The control module is also configured to generate a second signal for controlling a movement of the actuator assembly based on the first signal. The control module is further configured to transmit the second signal to the actuator assembly in order to move the upper structure by a second pitch angle.

20 Claims, 7 Drawing Sheets

(56) References Cited

U.S. PATENT DOCUMENTS

| | | | | |
|---|---|---|---|---|
| 2009/0157265 | A1* | 6/2009 | Kim | E02F 9/028 701/50 |
| 2014/0237866 | A1* | 8/2014 | Paull | E02F 5/145 700/275 |
| 2016/0369479 | A1* | 12/2016 | Tanaka | E02F 3/431 |
| 2017/0234119 | A1 | 8/2017 | Allen et al. | |
| 2019/0011933 | A1 | 1/2019 | Stacy, II | |
| 2019/0032433 | A1 | 1/2019 | Sawa et al. | |
| 2019/0316417 | A1* | 10/2019 | Krelifaoui | E21B 7/024 |

* cited by examiner

MACHINE AND METHOD OF MOVING UPPER STRUCTURE OF MACHINE

CROSS-REFERENCE TO RELATED APPLICATION

This application claims priority under 35 USC § 119 and the Paris Convention to Indian Patent Application 201911049406 filed on Dec. 2, 2019.

TECHNICAL FIELD

The present disclosure relates to machines, such as those used at mining worksites, and a method of moving an upper structure of such machines.

BACKGROUND

A machine, such as a drilling machine operating at a mining worksite, includes a movable carrier, a boom member, and a feed assembly. The movable carrier includes an upper structure and a lower structure. In situations where the machine is moving on a rough terrain or a slope, it is desirable to move the upper structure relative to the lower structure so that the operator may be seated in an upright condition within an operator cabin on the machine. Typically, oscillation cylinders are disposed on the machine to move, and more particularly, oscillate the upper structure relative to the lower structure.

Currently, the upper structure is adjusted using the oscillation cylinders based on inputs from an operator of the machine. The inputs are provided using one or more buttons in the operator cabin. More particularly, during tramming of the machine, the operator may press the oscillation buttons to provide the inputs for adjustment of the upper structure. Moreover, the operator may have to repeatedly provide the inputs by pressing the oscillation buttons when the machine is tramming on uneven surfaces. Such a technique of adjusting the upper structure based on manual inputs is prone to errors as the operator may forget to provide the inputs. This conventional technique of adjusting the upper structure may also cause operator fatigue.

Further, during a drilling operation, it is desirable to lock the oscillation cylinders to ensure that the machine is stable during the drilling operation. Thus, the operator needs to manually switch on an oscillation locking feature associated with the machine using a button provided in the operator cabin to ensure machine stability. In a situation wherein the operator does not switch on the oscillation locking feature, a quality of a drilling operation being performed by the machine may be compromised and it may also lead to operator discomfort while the drilling operation is in progress.

U.S. Publication Application No. 2017/0234119, hereinafter referred to as '119 application, describes industrial machines and methods of operating the same. One method includes receiving, with an electronic processor, a current value of a parameter of an industrial machine during operation of the industrial machine and comparing, with the electronic processor, the current value of the parameter to a stored value of the parameter to determine whether the industrial machine is unlevel. The method also includes, when the industrial machine is unlevel, autonomously, with the electronic processor, changing a position of at least one of a plurality of jacks to level the industrial machine, wherein autonomously changing the position of at least one of the plurality of jacks includes at least one selected from a group consisting of extending the at least one of the plurality of jacks and retracting the at least one of the plurality of jacks. However, the '119 application does not describe an automated control system that uses components present on the machine for levelling the industrial machine on a real time basis. Instead, the '119 application describes use of externally mounted jacks that extend or retract in order to level the industrial machine.

SUMMARY OF THE DISCLOSURE

In an aspect of the present disclosure, a machine operating on a work surface is provided. The machine includes a boom member. The machine also includes a feed assembly movably coupled to the boom member. The machine further includes a work device coupled at a distal portion of the feed assembly. The machine includes a movable carrier coupled to the boom member. The movable carrier includes a lower structure and an upper structure movably coupled with the lower structure. The machine further includes an actuator assembly adapted to move the upper structure relative to the lower structure. The machine also includes a sensor module mounted on the machine. The sensor module is configured to generate a first signal indicative of a first pitch angle of the machine relative to a non-inclined surface. The machine further includes a control module communicably coupled to the sensor module and the actuator assembly. The control module is configured to receive the first signal indicative of the first pitch angle of the machine from the sensor module. The control module is also configured to generate a second signal for controlling a movement of the actuator assembly based on the first signal. The control module is further configured to transmit the second signal to the actuator assembly in order to move the upper structure by a second pitch angle, such that a plane defined by an operator cabin of the machine is substantially parallel to the non-inclined surface. Further, the second pitch angle is opposite in direction to the first pitch angle.

In another aspect of the present disclosure, a method of moving an upper structure of a machine operating on a work surface is provided. The machine includes a lower structure and an actuator assembly adapted to move the upper structure relative to the lower structure. The method includes generating a first signal, by sensor module mounted on the machine, indicative of a first pitch angle of the machine relative to a non-inclined surface. The method also includes receiving, by a control module associated with the machine, the first signal from the sensor module. The method further includes generating, by the control module, a second signal for controlling a movement of the actuator assembly based on the first signal. The method includes transmitting, by the control module, the second signal to the actuator assembly in order to move the upper structure by a second pitch angle, such that a plane defined by an operator cabin of the machine is substantially parallel to the non-inclined surface. Further, the second pitch angle is opposite in direction to the first pitch angle.

In yet another aspect of the present disclosure, a computer program is provided. The computer program includes a program code means that is configured to cause a machine operating on a work surface to execute a method step of generating a first signal, by sensor module mounted on the machine, indicative of a first pitch angle of the machine relative to a non-inclined surface. The program code means is also configured to execute a method step of receiving, by a control module associated with the machine, the first signal from the sensor module. The program code means is further configured to execute a method step of generating, by the control module, a second signal for controlling a movement of an actuator assembly of the machine based on the first signal. The actuator assembly is adapted to move an upper structure of the machine relative to a lower structure of the machine. The program code means is also configured to execute a method step of transmitting, by the control module, the second signal to the actuator assembly in order to move the upper structure by a second pitch angle, such that a plane defined by an operator cabin of the machine is substantially parallel to the non-inclined surface. Further, the second pitch angle is opposite in direction to the first pitch angle.

Other features and aspects of this disclosure will be apparent from the following description and the accompanying drawings.

DETAILED DESCRIPTION

Figure 1:
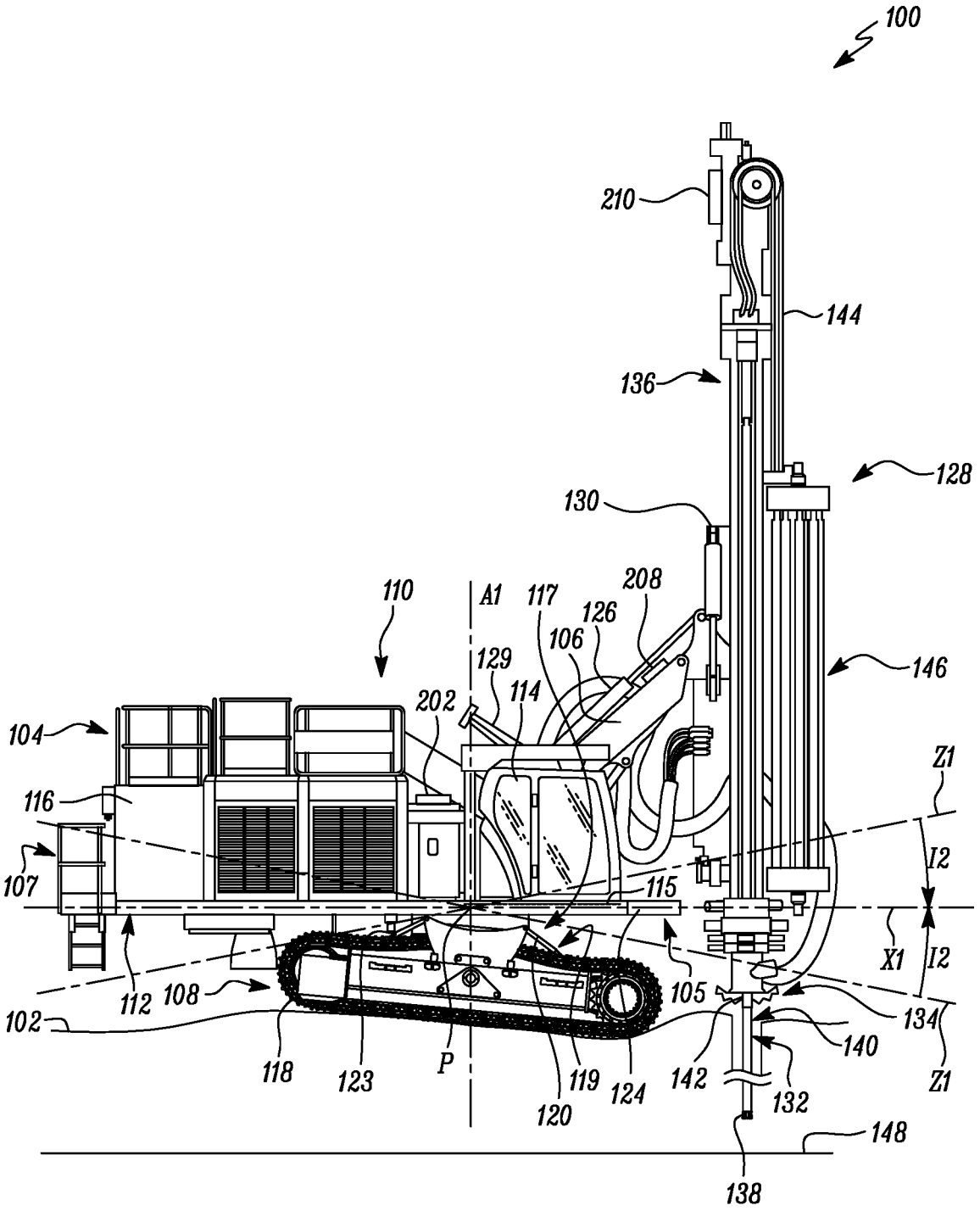
FIG. 1 is a side view of a machine, according to one embodiment of the present disclosure.

Wherever possible, the same reference numbers will be used throughout the drawings to refer to the same or like parts. Referring to FIG. 1, a side view of an exemplary machine 100 is illustrated. The machine 100 operates on a work surface 102. As illustrated, the work surface 102 is embodied as a rocky terrain. The work surface 102 is embodied as an uneven surface including a number of undulations, such as, bumps 302 (shown in FIG. 3), depressions 304 (shown in FIG. 3), and slopes (shown in FIG. 4) present thereon.

Further, when the machine 100 is operating on uneven surfaces or a slope, such as the slope 402, the machine 100 may be disposed at a first pitch angle "I1" (shown in FIG. 4) relative to a non-inclined surface 148. It should be noted that the term "non-inclined surface" as used herein may be defined as a surface having zero slope or inclination. For example, when the machine 100 is ascending or descending the slope 402, the machine 100 may be disposed at the first pitch angle "I1". The first pitch angle "I1" may be defined between the machine 100 and the non-inclined surface 148. The term "first pitch angle" as used herein may refer to an angle by which the machine 100 may be inclined relative to the non-inclined surface 148.

The machine 100 is embodied as a drilling machine. More specifically, the machine 100 is a boom mounted drilling machine. In other embodiments, the machine 100 may be any other drilling machine, such as a surface drilling machine, a rotary blasthole type drilling machine, and so on, based on application requirements. The machine 100 performs various drilling related operations, such as sub-surface mineral extraction, mineral exploration, environmental exploration, hydraulic fracturing, oil, gas, and/or water extraction wells, rock cut drilling for mining and/or quarrying operations, and the like, based on application requirements.

The machine 100 includes a movable carrier 104 coupled to a boom member 106. The movable carrier 104 defines a front end 105 and a rear end 107. The movable carrier 104 includes a lower structure 108 and an upper structure 110 movably coupled with the lower structure 108. Further, the upper structure 110 defines a chassis 112. The chassis 112 supports one or more components of the machine 100 thereon. The machine 100 also includes an operator cabin 114 mounted on the chassis 112. The operator cabin 114 may include one or more controls, such as one or more operator consoles, joysticks, pedals, levers, buttons, switches, steering, and so on. The controls are used to control an operation of the machine 100 on the work surface 102. Further, the operator cabin 114 defines a plane 115. The plane 115 is generally parallel to a floor of the operator cabin 114. Moreover, when the machine 100 is operating on a flat surface, the plane 115 defined by the operator cabin 114 is substantially parallel to the non-inclined surface 148.

Figure 1A:
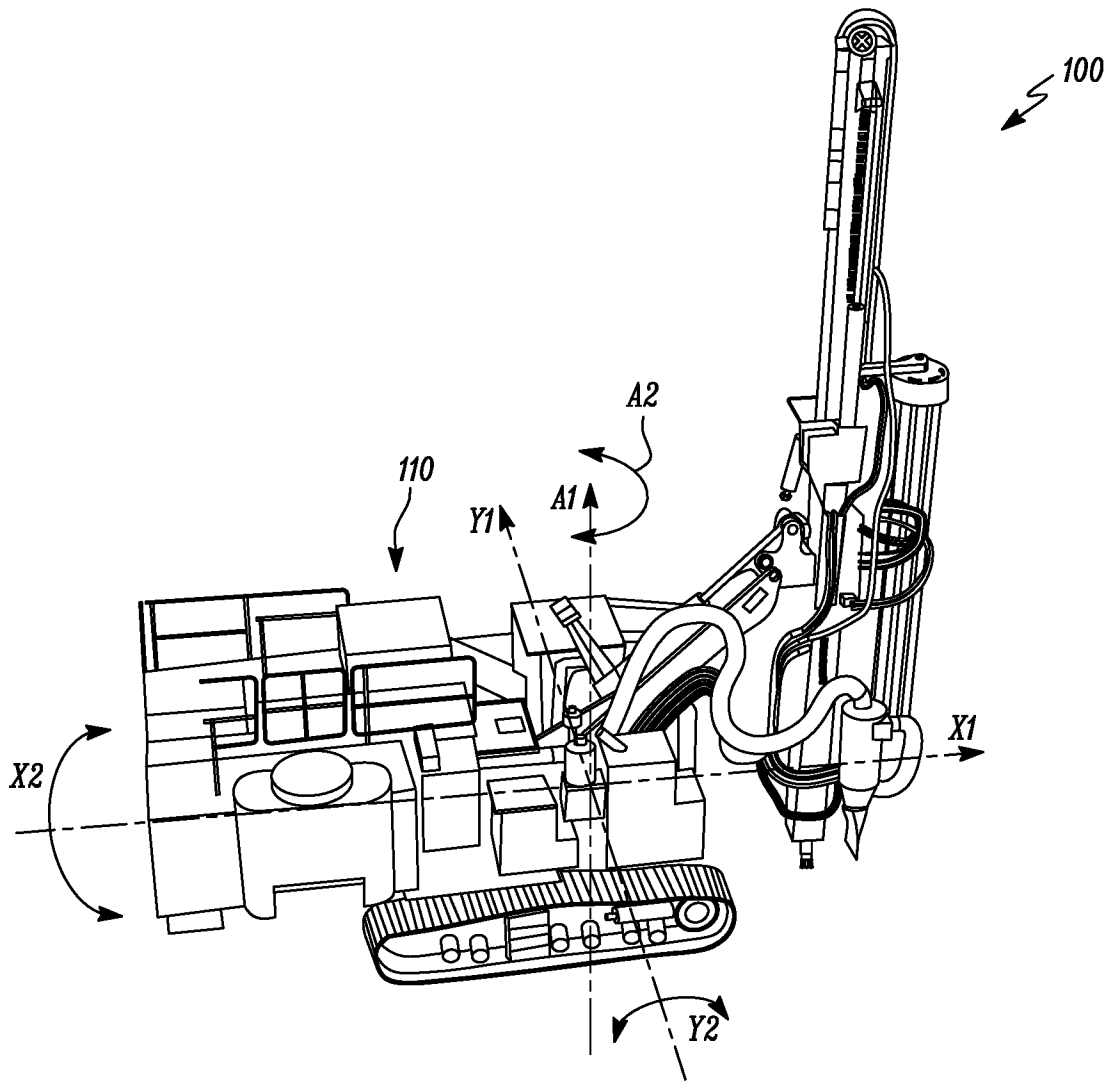
FIG. 1A is a perspective view of the machine of FIG. 1 illustrating axes defined by the machine about which an upper structure of the machine is adapted to move.

As shown in FIG. 1A, the upper structure 110 defines a first axis "A1". The upper structure 110 may move about the axis "A1". This movement may be referred to as a yaw movement "A2" of the machine 100. Further, the machine 100 defines a second axis "X1". The upper structure 110 may move about the axis "X1". This movement may be referred to as a roll movement "X2" of the machine 100.

Further, the machine 100 defines an axis "Y1" about which the upper structure 110 oscillates in a clockwise direction "C1" or an anti-clockwise direction "C2", about a pivot point "P" (shown in FIG. 1). This movement may be referred to as a pitch movement "Y2" of the machine 100. The machine 100 defines an axis "Z1" (shown in FIGS. 1, 3, and 4). When the upper structure 110 oscillates, the axis "Z1" is disposed at a second pitch angle "I2" (shown in FIGS. 1, 3, and 4) with respect to the second axis "X1". The second pitch angle "I2" may be defined between the axis "Z1" and the second axis "X1". It should be noted that the term "second pitch angle" as referred to herein may be defined as an angle corresponding to the pitch movement "Y2" of the machine 100. Further, the axis "Z1" may correspond to the second axis "X1" when the machine 100 is operating on a flat surface.

The machine 100 also includes an enclosure 116 provided on the chassis 112. The enclosure 116 encloses a power source (not shown) mounted on the chassis 112. The power source provides power to the machine 100 for mobility and operational requirements. The power source may include, but not limited to, a diesel engine, a gasoline engine, a gaseous fuel powered engine, a dual fuel powered engine, an electric motor, a fuel cell, a battery, and/or a combination thereof, based on application requirements. Additionally, the machine 100 may include components and/or systems (not shown), such as a fuel delivery system, an air delivery system, a lubrication system, a propulsion system, a drive-train, a drive control system, a machine control system, and so on, based on application requirements.

As illustrated, the lower structure 108 includes an under-carriage structure. The lower structure 108 includes a set of ground engaging members 118 (only one ground engaging member shown in the accompanying figure). In the illustrated embodiment, the ground engaging members 118 are embodied as tracks. In other embodiments, the ground engaging members 118 may embody wheels. The ground engaging members 118 support and provide mobility to the machine 100 on the work surface 102. As such, the ground engaging members 118 provide movement, turning, positioning, and travel of the machine 100 on the work surface 102.

Further, the machine 100 includes an actuator assembly 117 to move the upper structure 110 relative to the lower structure 108. In the illustrated example, the actuator assembly 117 moves the upper structure 110 about the axis "Z1". The actuator assembly 117 allows the upper structure 110 to oscillate or move in the clockwise direction "C1" or the anti-clockwise direction "C2" relative to the lower structure 108. Further, the actuator assembly 117 moves the upper structure 110 in the clockwise direction "C1" or the anti-clockwise direction "C2" by the second pitch angle "I2". The upper structure 110 is movable by the actuator assembly 117, about the axis "Z1" by the second pitch angle "I2", so that the operator can be seated upright within the operator cabin 114, such as during tramming or drilling operations. In some examples, the second pitch angle "I2" is equal in magnitude to the first pitch angle "I1". More particularly, in some examples, the actuator assembly 117 may tilt the upper structure 110 by the same amount as the first pitch angle "I1" of the machine 100.

Further, the second pitch angle "I2" is opposite in direction with respect to the first pitch angle "I1". More particularly, a direction of movement of the upper structure 110 may be based on the terrain of the work surface 102. Accordingly, the upper structure 110 may tilt in the clockwise direction "C1" or the anti-clockwise direction "C2" by the second pitch angle "I2" based on undulations such as bumps/depressions or various slopes present at the work surface 102. For example, if the machine 100 tilts in the clockwise direction "C1", the upper structure 110 may tilt by the second pitch angle "I2" in the anti-clockwise direction "C2". Further, if the machine 100 tilts in the anti-clockwise direction "C2", the upper structure 110 may tilt by the second pitch angle "I2" in the clockwise direction "C1". It should be noted that the work surface 102 is shown generally parallel to the non-inclined surface 148 in FIGS. 1 & 3.

Further, the machine 100 also includes an oscillation locking feature that allows locking of the actuator assembly 117 so that any movement of the upper structure 110 is restricted during drilling operations. The actuator assembly 117 includes one or more first actuators 120 mounted proximate to the front end 105 of the movable carrier 102 and one or more second actuators 123 mounted proximate to the rear end 107 of the movable carrier 102. In the illustrated example, the actuator assembly 117 includes a first pair of actuators 119 disposed at a right side of the machine 100 and a second pair of actuators 121 (see FIG. 2) disposed at a left side of the machine 100. Further, each of the pair of actuators 119, 121 includes the first actuator 120 mounted proximate to the front end 105 of the movable carrier 104 and the second actuator 123 mounted proximate to the rear end 107 of the movable carrier 104.

The first and second pair of actuators 119, 121 are paired together such that when the respective first actuators 120 extend by a desired amount, the respective second actuators 123 retract by the amount that is same as the extension of the first actuator 120, and vice versa. Alternatively, the machine 100 may include a single pair of first actuators 120 mounted proximate to the front end 105 of the movable carrier 104, without any limitations.

The first and second actuators 120, 123 may include a hydraulic actuator or a pneumatic actuator. Each of the actuators 120, 123 includes a cylinder, a piston, and a rod. In an example, the cylinder is connected to the upper structure 110 and the rod is connected to the lower structure 108. A movement of the rod of the actuators 120, 123 causes the upper structure 110 to move relative to the lower structure 108. More particularly, the extension of each of the actuators 120 and the retraction of each of the actuators 123 causes the upper structure 110 to move in the anti-clockwise direction "C2" by the second pitch angle "I2". Whereas, the retraction of each of the actuators 120 and the extension of each of the actuators 123 causes the upper structure 110 to move in the clockwise direction "C1" by the second pitch angle "I2".

The machine 100 also includes a deck frame 124 disposed on the chassis 112. The deck frame 124 provides an operating surface on the machine 100. As such, the deck frame 124 may provide the operating surface for the operator to move around the machine 100 or be stationed on the machine 100, to support one or more components of the machine 100, and so on. The machine 100 also include the boom member 106. The boom member 106 is movably coupled to the chassis 112 using a shift cylinder 126. The machine 100 also includes a feed assembly 128. The feed assembly 128 is movably coupled to the boom member 106. The feed assembly 128 includes a feed table 130 disposed on the chassis 112. The feed table 130 is a linearly extending structure, and in the accompanying figure, is upright. The feed table 130 supports one or more drilling components of the machine 100. The feed table 130 allows a drill string 140 to move relative to the feed table 130. The feed table 130 includes a drive motor not shown) for moving the drill string 140. The feed table 130 is pivotally coupled to the chassis 112 by the boom member 106.

As such, the feed assembly 128 is movable relative to the chassis 112 between a substantially vertical position (shown in the accompanying FIG. 1) and a non-vertical position (shown in FIGS. 3 and 4), also known as a rest position based on operation of the shift cylinder 126. In the rest position, the boom member 106 rests on a feed rest 129. The feed rest 129 is a generally embodied as a bar member that supports the feed assembly 128 when the feed assembly 128 is in the rest position. Further, the shift cylinder 126 provides alignment of the feed table 130 along a height and a width of the chassis 112.

The machine 100 includes a work device 132 coupled at a distal portion 134 of the feed assembly 128. The work device 132 is embodied as a drill assembly. The work device 132 is movably disposed on the feed table 130 via a mast 136. The work device 132 may drill holes, channels, tunnels, openings, and so on into, within, and/or extending into, and/or below, the work surface 102. Accordingly, the work device 132 includes a drill bit 138 and a drill string 140 removably coupled to the drill bit 138.

The drill string 140 includes one or more columns or pipes 142 interlinked with each other and with the drill bit 138. Each of the pipes 142 of the work device 132 have a hollow and generally cylindrical configuration. The pipes 142 provide extension of the drill bit 138 into a portion of the work surface 102. For example, each pipe 142 may be coupled to another pipe 142 by way of a threaded connection (not shown). In other embodiments, the pipes 142 may be interlinked with each other by way of other similar connections, for example, by lock fittings, snap fittings, and so on, based on application requirements. The drill string 140 is slidably coupled with the feed table 130 via supporting rails 144 and may be driven by the drive motor to slidably move relative to the feed table 130 on the supporting rails 144.

The feed assembly 128 also includes a carousel 146. The carousel 146 is disposed on the feed table 130 via the mast 136. The carousel 146 may store and support one or more pipes 142 of the work device 132 when the work device 132 is not in use. In one example, the carousel 146 includes a plurality of slots (not shown) for holding the pipes 142. The carousel 146 may also be used to add pipes 142 to the work device 132 to form the drill string 140 when in use. Additionally, the feed assembly 128 may include one or more components and systems (not shown), such as a drive mechanism including a motor, a chain, a sprocket, etc., a rotary mechanism, actuators, adapters, guiding members, valves, sensors, controllers, and the like, based on application requirements. It should be noted that the boom member 106 and the feed assembly 128 can be moved to various angles based on movement of the shift cylinder 126 or other cylinders associated with the boom member 106 and the feed assembly 128. Thus, the machine 100 can be used to perform drilling operations at various angles, as per application requirements.

The machine 100 includes a system 200 (shown in FIG. 2) for moving the upper structure 110. More particularly, the system 200 allows the upper structure 110 to move by the second pitch angle "I2". The system 200 initiates an auto cabin levelling feature in order to tilt the upper structure 110 so that the plane 115 defined by the operator cabin 114 is substantially parallel to the non-inclined surface 148. In an example, the system 200 allows adjustment of the upper structure 110 during tramming of the machine 100. In another example, the system 200 also allows adjustment of the upper structure 110 prior to an initiation of drilling operations by the machine 100.

Figure 2:
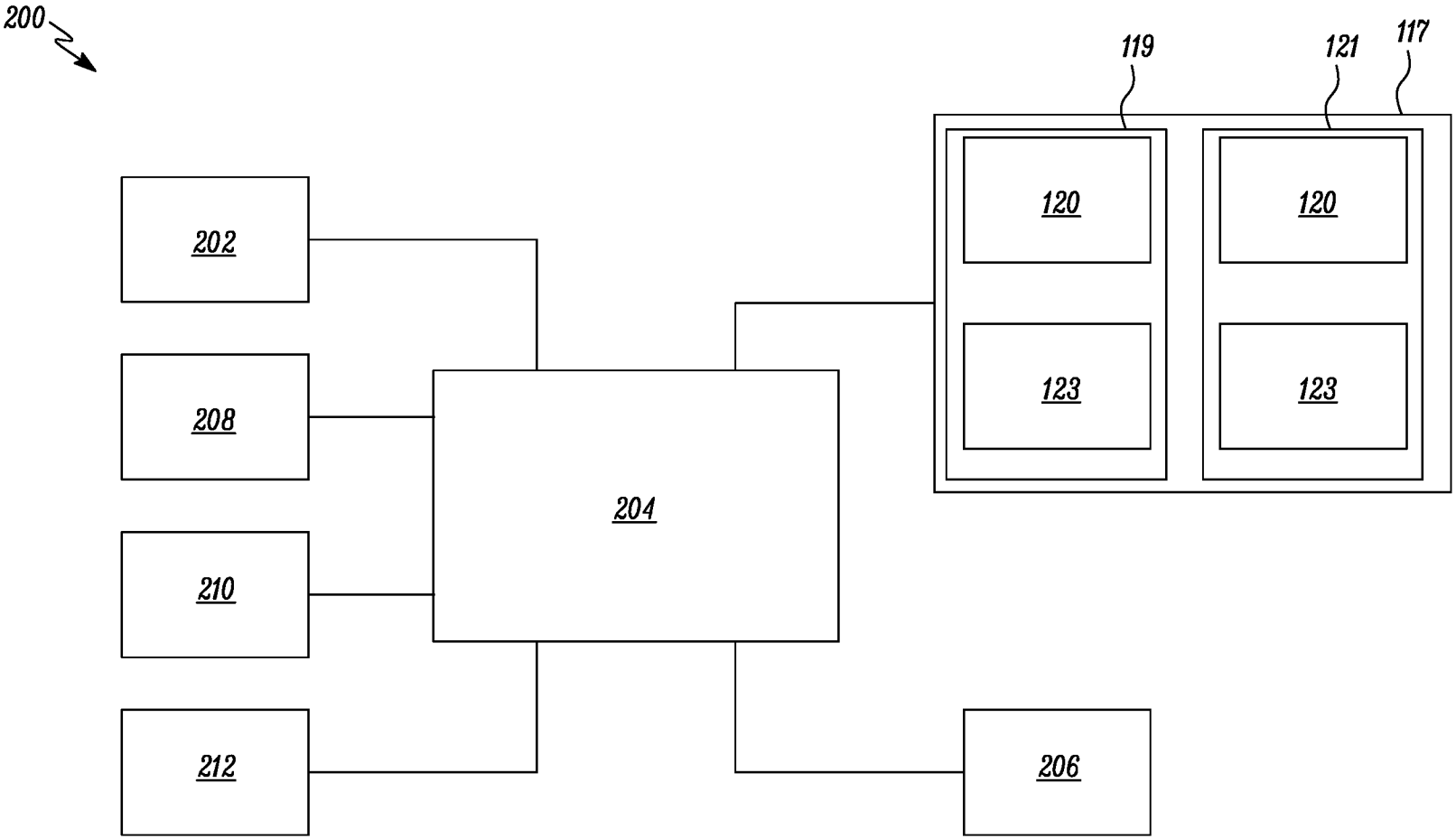
FIG. 2 is a block diagram illustrating a system for moving the upper structure of the machine shown in FIG. 1.

As shown in FIG. 2, the system 200 includes a sensor module 202, a control module 204, and an output module 206. More particularly, the machine 100 (see FIG. 1) includes the sensor module 202 mounted on the machine 100. In the illustrated example, the sensor module 202 is mounted on the upper structure 110 (see FIG. 1). It should be noted that a position of the sensor module 202 illustrated herein is exemplary in nature, and the sensor module 202 may be disposed at another location on the upper structure 110, as per requirements. The sensor module 202 is hereinafter interchangeably referred to as the first sensor module 202. The sensor module 202 generates a first signal indicative of the first pitch angle "I1" of the machine 100 relative to the non-inclined surface 148 (see FIG. 1). In an example, the sensor module 202 includes an inertial measurement unit. In another example, the sensor module 202 includes an inclinometer. Alternatively, the sensor module 202 may include another type of sensor, such as a position sensor, a tilt sensor, and the like, or a combination of sensors that realize the function of the sensor module 202, as per requirements.

Further, the machine 100 also includes a second sensor module 208 and a third sensor module 210. The second sensor module 208 is mounted on the boom member 106 (see FIG. 1) and the third sensor module 210 is mounted on the feed assembly 128 (see FIG. 1). In an example, the second and third sensor modules 208, 210 include an inertial measurement unit. The second sensor module 208 may be used to determine the position of the boom member 106, whereas the third sensor module 210 may be used to determine the position of the feed assembly 128. Further, the machine 100 includes a fourth sensor module 212. The fourth sensor module 212 may include an in-cylinder position sensor for generating an indication corresponding to a position of the pipes 142 (see FIG. 1). For example, the fourth sensor module 212 may generate an indication of extension or retraction of the pipes 142. Further, the machine 100 may include another sensor module (not shown) that may include a depth sensor for generating an indication corresponding to a depth of penetration of one or more pipes 142 into the work surface 102 (see FIG. 1).

The machine 100 also includes the control module 204. The control module 204 is communicably coupled to the sensor module 202 and the actuator assembly 117. Further, the control module 204 is also communicably coupled to the second, third, and fourth sensor modules 208, 210, 212. The control module 204 receives the first signal indicative of the first pitch angle "I1" (see FIG. 4) of the machine 100 from the sensor module 202. Further, the control module 204 determines the second pitch angle "I2" (see FIGS. 3, and 4) based on the first signal. The second pitch angle "I2" is opposite in direction with respect to the first pitch angle "I1". When the upper structure 110 is moved by the determined second pitch angle "I2", the plane 115 (see FIG. 1) defined by the operator cabin 114 (see FIG. 1) is substantially parallel to the non-inclined surface 148.

Further, the actuator assembly 117 moves the upper structure 110 in the clockwise direction "C1" or the anti-clockwise direction "C2". More particularly, the actuator assembly 117 moves the upper structure 110 by the second pitch angle "I2" in the clockwise or anti-clockwise directions "C1", "C2" based on the tilting of the machine 100 in the clockwise or anti-clockwise directions "C1", "C2". It should be noted that the first signal is analyzed to conclude if the upper structure 110 needs to be moved in the clockwise direction "C1" (see FIG. 1) or the anti-clockwise direction "C2" (see FIG. 1). When the machine 100 encounters the bump 302 (see FIG. 3) on the work surface 102 or the machine 100 is ascending/descending the slope 402 (see FIG. 4), the control module 204 concludes that the upper structure 110 needs to be moved in the clockwise direction "C1" by the second pitch angle "I2". Further, when the machine 100 encounters the depression 304 (see FIG. 3) in the work surface 102, the control module 204 concludes that the upper structure 110 needs to be moved in the anti-clockwise direction "C2" by the second pitch angle "I2"

Further, the control module 204 compares the second pitch angle "I2" with a predetermined threshold range of the second pitch angle "I2". More particularly, the control module 204 determines if the determined second pitch angle "I2" lies within the predetermined threshold range of the second pitch angle "I2". The predetermined threshold range defines a minimum threshold value and a maximum threshold value by which the upper structure 110 can be moved.

The control module 204 compares the determined second pitch angle "I2" with the minimum threshold value and the maximum threshold value. In an example, the minimum threshold value may be approximately equal to 2 Degrees, such that the auto cabin levelling feature is triggered only when the second pitch angle "I2" is greater than 2 Degrees. Further, the maximum threshold value may be approximately equal to 10 Degrees. Accordingly, the auto cabin levelling feature may cause the oscillation of the upper structure 110 only when the second pitch angle "I2" is between 2 Degrees and 10 Degrees. Further, if the second pitch angle "I2" is greater than 10 Degrees, the auto cabin levelling feature may cause the upper structure 110 to oscillate by 10 Degrees. Accordingly, the predetermined threshold range of the second pitch angle "I2" may be approximately equal to 2 Degrees and 10 Degrees, without any limitations. It should be noted that values of the predetermined threshold range, the minimum threshold value, and the maximum threshold value as mentioned herein are exemplary in nature, and the values may vary as per application requirements. The minimum and maximum threshold values may be prestored within a memory of the control module 204.

Further, the control module 204 generates a second signal for controlling the movement of the actuator assembly 117 based on the first signal. More particularly, the second signal may be indicative of an amount by which the respective actuators 120, 123 need to extend or retract in order to tilt the upper structure 110 by the second pitch angle "I2" in the clockwise or anti-clockwise directions "C1", "C2". Further, the control module 204 transmits the second signal to the actuator assembly 117 in order to move the upper structure 110 by the second pitch angle "I2", such that the plane 115 defined by the operator cabin 114 of the machine 100 is substantially parallel to the non-inclined surface 148.

Further, if the determined second pitch angle "I2" is within the predetermined threshold range of the second pitch angle "I2", the control module 204 generates the second signal for controlling the movement of the actuator assembly 117. Accordingly, the control module 204 transmits the second signal to the actuator assembly 117 for moving the upper structure 110 such that the second pitch angle "I2" is within the predetermined threshold range of the second pitch angle "I2". However, if the determined second pitch angle "I2" is more than the maximum threshold value, the control module 204 moves the upper structure 110 by the maximum threshold value of the second pitch angle "I2".

Figure 3:
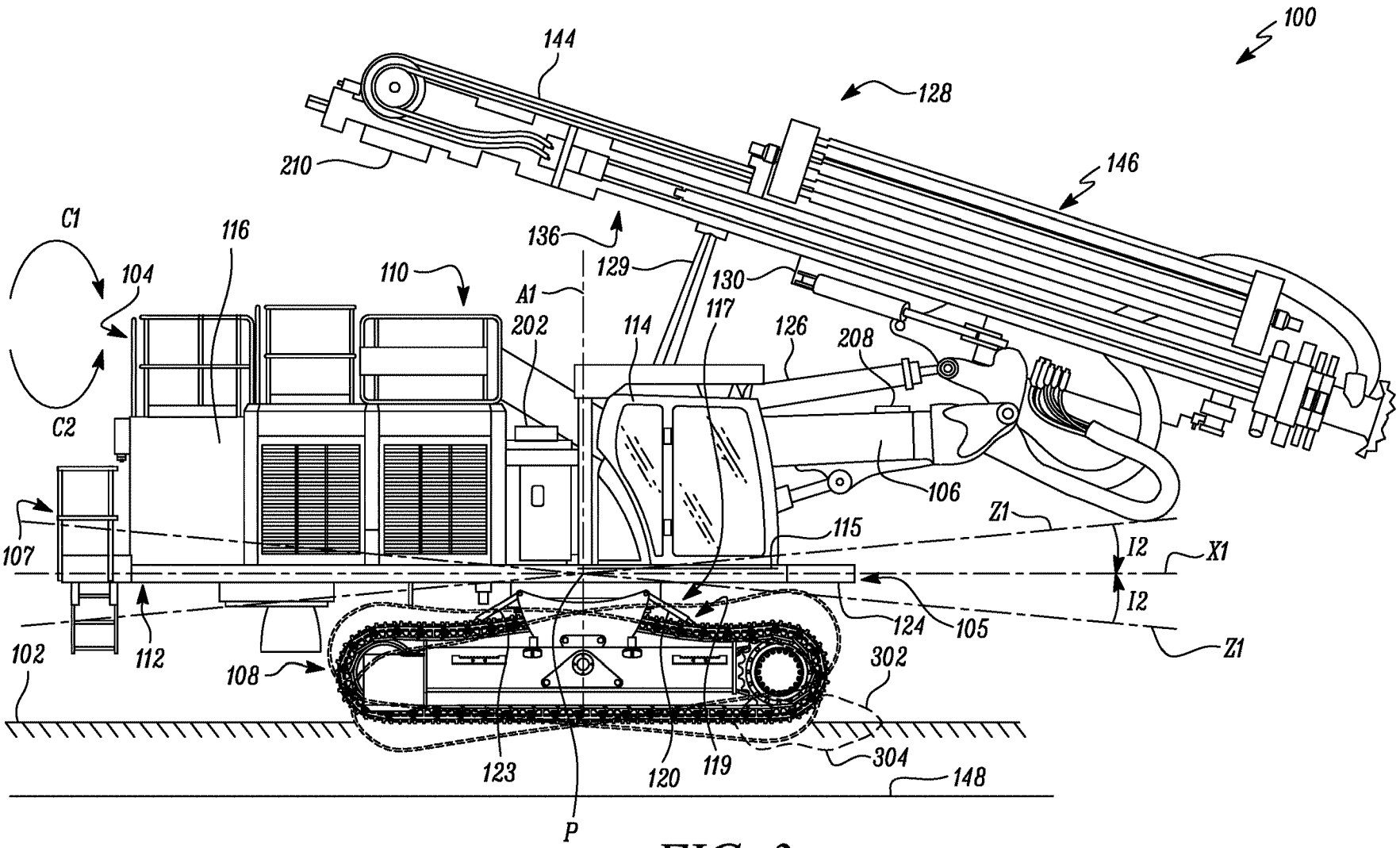
FIG. 3 is a side view of the machine shown in FIG. 1 illustrating operation of the machine on a rough terrain.

As shown in FIG. 3, when the machine 100 is operating on the work surface 102 having an uneven surface, the system 200 (see FIG. 2) operates so that the upper structure 110 is movable by the second pitch angle "I2". Accordingly, when the machine encounters the bump 302, the machine 100 tilts in the anti-clockwise direction "C2". The control module 204 (see FIG. 2) transmits the control signals to tilt the upper structure 110 in the clockwise direction "C1" by the second pitch angle "I2". Further, the control module 204 controls the movement of the actuators 120, 123 so that the upper structure 110 is movable by the second pitch angle "I2" in the clockwise direction "C1". More particularly, the control module 204 transmits control signals to retract the actuators 120 and to extend the actuators 123 such that the upper structure 110 moves in the clockwise direction "C1" by the second pitch angle "I2".

Further, when the machine 100 encounters the depression 304, the machine 100 tilts in the clockwise direction "C1". Accordingly, the control module 204 transmits the control signals to tilt the upper structure 110 in the anti-clockwise direction "C2" by the second pitch angle "I2". Further, the control module 204 controls the movement of the actuators 120, 123 so that the upper structure 110 is movable by the second pitch angle "I2" in the anti-clockwise direction "C2". More particularly, the control module 204 transmits control signals to extend the actuators 120 and to retract the actuators 123 such that the upper structure 110 moves in the anti-clockwise direction "C2" by the second pitch angle "I2".

Figure 4:
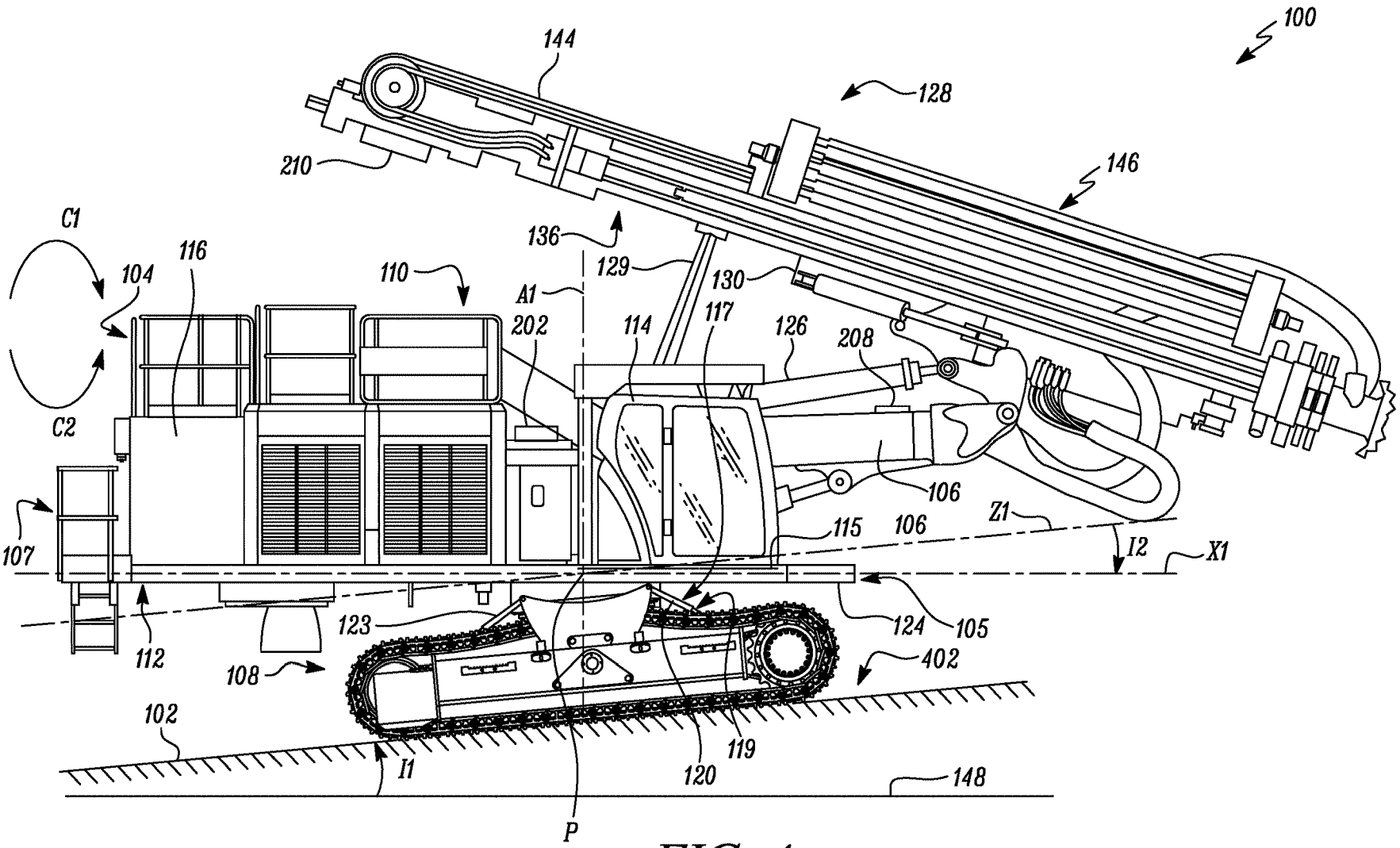
FIG. 4 is a side view of the machine shown in FIG. 1 illustrating operation of the machine on a slope.

Referring now to FIG. 4, the machine 100 is disposed at the first pitch angle "I1" as the machine 100 is ascending the slope 402. The accompanying figure illustrates the upper structure 110 moved by the second pitch angle "I2" so that the plane 115 defined by the operator cabin 114 is substantially parallel to the non-inclined surface 128. More particularly, when the machine 100 starts ascending the slope 402, the slope 402 causes the machine 100 to tilt in the anti-clockwise direction "C2". Further, the control module 204 (see FIG. 2) transmits the control signals to tilt the upper structure 110 in the clockwise direction "C1" by the second pitch angle "I2". Moreover, the control module 204 controls the movement of the actuators 120, 123 to move the upper structure 110 by the second pitch angle "I2". More particularly, the control module 204 transmits control signals to retract the actuators 120 and to extend the actuators 123 such that the upper structure 110 moves in the clockwise direction "C1" by the second pitch angle "I2".

Further, when the machine 100 is about to descend the slope 402, the slope 402 causes the machine 100 to tilt in the anti-clockwise direction "C2". Accordingly, the control module 204 transmits the control signals to tilt the upper structure 110 in the clockwise direction "C1" by the second pitch angle "I2". More particularly, the control module 204 controls the movement of the actuators 120, 123 to move the upper structure 110 by the second pitch angle "I2". It should be noted that the control module 204 transmits control signals to retract the actuators 120 and to extend the actuators 123 such that the upper structure 110 moves in the clockwise direction "C1" by the second pitch angle "I2". However, when the slope 402 is oriented in such a way that the machine 100 tilts in the clockwise direction "C1", the control module 204 may transmits control signals to tilt the upper structure 110 in the anti-clockwise direction "C2" by the second pitch angle "I2".

The machine 100 includes the output module 206 (shown in FIG. 2). The output module 206 is communicably coupled with the control module 204. The output module 206 presents the first pitch angle "I1" or the second pitch angle "I2" thereon. In other examples, the output module 206 may provide other notifications, without any limitations. The output module 206 is located in the operator cabin 114. In an example, the output module 206 may be embodied as a display device that may be present in the operator cabin 114. Additionally, or alternatively, the output module 206 may provide audio notifications. In such an example, the output module 206 may generate a voice alert. For example, the output module 206 may embody a speaker that provides the audio notifications to the operator.

In some examples, the output module 206 may be handheld by the operator such that the handheld device displays notifications corresponding to the first and second pitch angles "I1", "I2" thereon. The output module 206 may display the notifications via a Short Message Service (SMS), a Multimedia Message Service (MMS), a poll notification, an Electronic Mail (e-mail), etc. In an example, the output module 206 may be a portable computing device that operates using a portable power source such as a battery. Examples of the portable computing device may include, but are not limited to, a mobile phone, a smart phone, a palm top, a tablet, a laptop, and the like.

Further, the movement of the upper structure 110 of the machine 100 is carried out by executing a computer program designed for the purpose. The computer program is stored and executed by the control module 204. The computer program includes a program code means 500 to cause the machine 100 operating on the work surface 102 to execute a number of method steps. The program code means 500 may be defined as an algorithm that is implemented by the control module 204.

Figure 5:
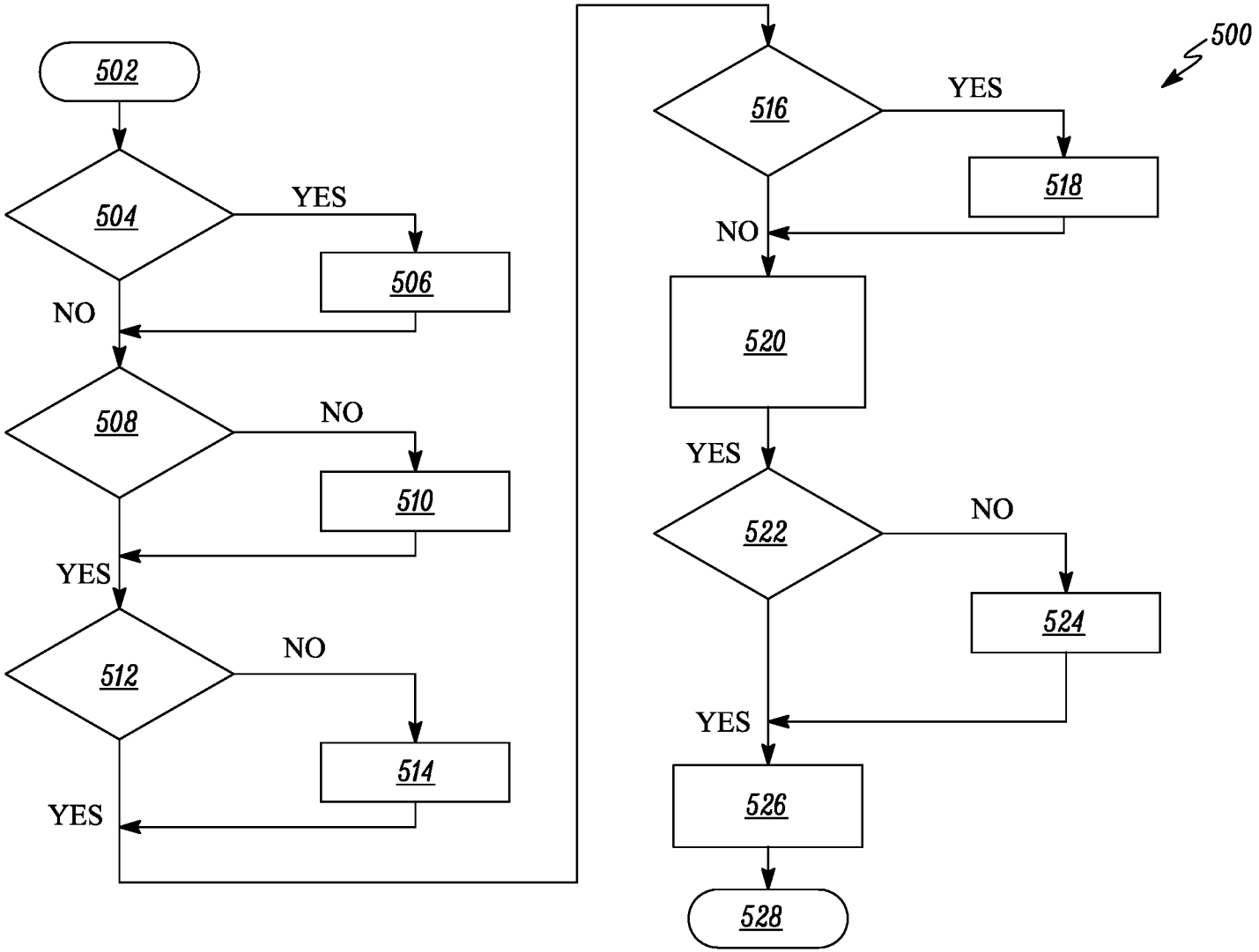
FIG. 5 is a flowchart for a program code means that executes various method steps in order to move the upper structure of the machine shown in FIG. 1.

FIG. 5 illustrates a flowchart for the program code means 500. In the illustrated example, the program code means 500 implemented during a tramming mode of the machine 100 is explained. However, the program code means 500 can be implemented when the machine 100 is operating in a drilling mode with some modifications to the method steps, without any limitations. The program code means 500 is implemented by the control module 204 and may be stored in the memory of the control module 204. Alternatively, the program code means 500 may be stored and implemented by an Electronic Control module (ECM) present on-board the machine 100, without any limitations.

At block 502 the operator may activate the auto cabin levelling feature. The program code means 500 starts or begins operation. In an example, the program code means 500 may be activated by operator input. Alternatively, the program code means 500 may begin operation as soon as the machine 100 is switched to the tramming mode. Further, at block 504, the control module 204 determines if one or more pipes 142 are present in a hole present at the work surface 102. At the block 504, the control module 204 performs a check to ensure that none of the pipes 142 are present in the hole and the machine 100 is not performing the drilling operation. However, if the control module 204 determines that one or more pipes 142 are present in the hole, the program code means 500 moves to block 506. At the block 506, the control module 204 provides a notification to remove the pipes 142 from the hole. In an example, the notification may be displayed on the output module 206. Accordingly, the pipes 142 may be removed from the hole manually or using an automatic pipe handling system.

However, if the control module 204 determines that all the pipes 142 are out of the hole, the program code means 500 directly moves to block 508. At the block 508, the control module 204 determines if the sensor modules 202, 208, 210, 212 mounted on the machine 100 are calibrated. Further, the control module 204 also determines if the sensor modules 202, 208, 210, 212 are operating accurately. If the control module 204 detects that the sensor modules 202, 208, 210, 212 are not calibrated, the program code means 500 moves to block 510. At the block 510, the control module 204 may send out a signal for calibration of the sensor modules 202, 208, 210, 212.

If the control module 204 detects that the sensor modules 202, 208, 210, 212 are calibrated and working accurately at the block 508, the program code means 500 moves to block 512. At the block 512, the control module 204 determines if the feed assembly 128 is in the rest position. The control module 204 determines the position of the feed assembly based on signals received from the second or third sensor modules 208, 210. If the control module 204 determines that the feed assembly 128 is not in the rest position, the program code means 500 moves to block 514. At the block 514, the control module 204 sends out signals to control the boom member 106 and the feed assembly 128 to move the feed assembly 128 to the rest position.

However, if the control module 204 determines that the feed assembly 128 is in the rest position at the block 512, the program code means 500 moves to block 516. At the block 516, the control module 204 determines if the oscillation locking feature of the machine 100 is activated. If the oscillation locking feature is activated, the program code means 500 moves to block 518. At the block 518, the control module 204 sends out a signal to deactivate the oscillation locking feature. However, if the oscillation locking feature is deactivated, the program code means 500 moves to block 520. At the block 520, the control module 204 associated with the machine 100 receives the first signal from the sensor module 202. As mentioned earlier, the sensor module 202 mounted on the machine 100 generates the first signal that is indicative of the first pitch angle "I1" of the machine 100 relative to the non-inclined surface 148. In an example, the sensor module 202 includes the inertial measurement unit mounted on the machine 100, such that the inertial measurement unit generates the first signal indicative of the first pitch angle "I1". At the block 520, the control module 204 also determines the second pitch angle "I2" based on the first signal. The second pitch angle "I2" is opposite in direction to the first pitch angle "I1". Further, in some examples, the second pitch angle "I2" is equal in magnitude to the first pitch angle "I1".

Further, the control module 204 compares the determined second pitch angle "I2" with the predetermined threshold range of the second pitch angle "I2". If the second pitch angle "I2" is less than the minimum threshold value of the second pitch angle "I2", the control module 204 directly moves to block 526. The steps performed by the control module 204 at the block 526 will be explained later in this section. However, if the second pitch angle "I2" is greater than the minimum threshold value of the second pitch angle "I2", the control module 204 proceeds operation.

Accordingly, the control module 204 generates the second signal for controlling the movement of the actuator assembly 117 of the machine 100 based on the first signal. Further, the control module 204 controls the movement of the actuator assembly 117 to move the upper structure 110 by the second pitch angle "I2" determined by the control module 204. More particularly, the control module 204 transmits the second signal to the actuator assembly 117 in order to move the upper structure 110 by the second pitch angle "I2", such that the plane 115 defined by the operator cabin 114 of the machine 100 is substantially parallel to the non-inclined surface 148. Based on the second signal, the actuator assembly 117 moves the upper structure 110 of the machine 100 relative to the lower structure 108 of the machine 100. It should be noted that the actuator assembly 117 may move the upper structure 110 in the clockwise direction "C1" or the anti-clockwise direction "C2" by the second pitch angle "I2".

Further, the program code means 500 moves to block 522. At the block 522, the control module 204 determines if the second pitch angle "I2" is within the predetermined threshold range of the second pitch angle "I2". Further, the control module 204 transmits the second signal to the actuator assembly 117 for moving the upper structure 110 such that the second pitch angle "I2" is within the predetermined threshold range of the second pitch angle "I2". More particularly, if the second pitch angle "I2" is greater than the maximum threshold value of the second pitch angle "I2", the control module 204 generates the second signal such that the actuator assembly 177 moves the upper structure 110 by the maximum threshold value of the second pitch angle "I2". However, if the second pitch angle "I2" lies within the predetermined threshold range of the second pitch angle "I2", the control module 204 directly moves to the block 526. At the block 526, the control module 204 sends the signal to display the first pitch angle "I1" or the second pitch angle "I2" on the output module 206.

Further, if the machine 100 is operating in the tramming mode, the control module 204 repeats all the method steps as applicable to dynamically move the upper structure 110 based on the terrain of the work surface 102. It should be noted that the method steps executed by the program code means 500 is similar in both the tramming and drilling modes of operation of the machine 100. However, if the machine 100 is operating in the drilling mode, the control module 204 also sends out signals to activate the oscillation locking feature to lock the actuator assembly 117 at the block 526. The program code means 500 ends operation at block 528.

In some examples, the ECM that is present on-board the machine 100 may perform the intended functions of the control module 204, without any limitations. The control module 204 may embody a single microprocessor or multiple microprocessors for receiving signals from various components of the machine 100. Numerous commercially available microprocessors may be configured to perform the functions of the control module 204. It should be appreciated that the control module 204 may embody a machine microprocessor capable of controlling numerous machine functions. A person of ordinary skill in the art will appreciate that the control module 204 may additionally include other components and may also perform other functions not described herein.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Figure 6:
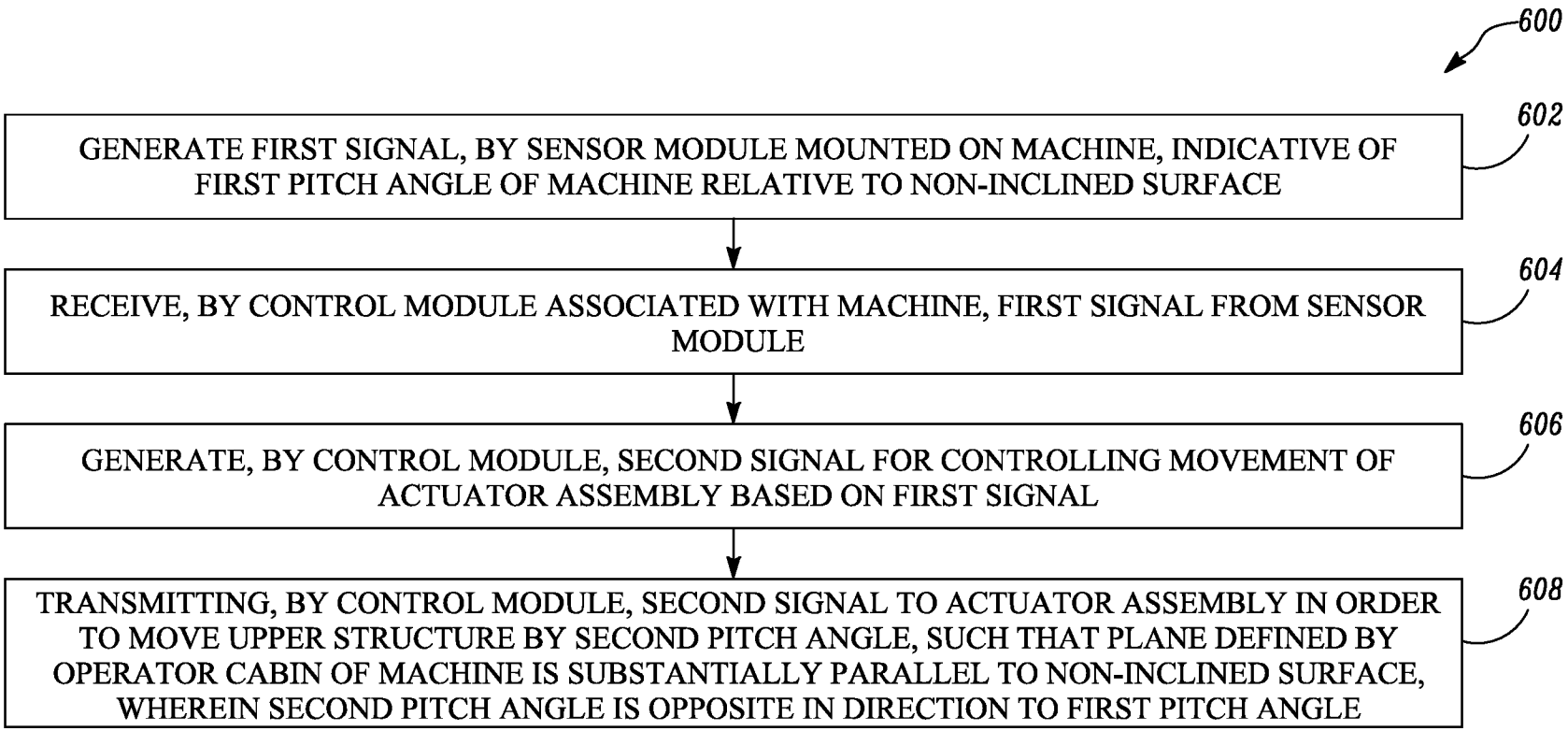
FIG. 6 is a flowchart for a method of moving the upper structure of the machine shown in FIG. 1 operating on the work surface.

Referring to FIG. 6, a flowchart for a method 600 of moving the upper structure 110 of the machine 100 operating on the work surface 102 is illustrated. The machine 100 includes the lower structure 108 and the actuator assembly 117 to move the upper structure 110 relative to the lower structure 108. At step 602, the first signal indicative of the first pitch angle "I1" of the machine 100 relative to the non-inclined surface 148 is generated by the sensor module 202 mounted on the machine 100.

At step 604, the control module 204 associated with the machine 100 receives the first signal from the sensor module 202. Further, the step of receiving the first signal includes mounting the inertial measurement unit on the machine 100, such that the inertial measurement unit generates the first signal indicative of the first pitch angle "I1". At step 606, the control module 204 generates the second signal for controlling the movement of the actuator assembly 117 based on the first signal.

At step 608, the control module 204 transmits the second signal to the actuator assembly 117 in order to move the upper structure 110 by the second pitch angle "I2", such that the plane 115 defined by the operator cabin 114 of the machine 100 is substantially parallel to the non-inclined surface 148, wherein the second pitch angle "I2" is opposite in direction to the first pitch angle "I1". It should be noted that the control module 204 controls the movement of the actuator assembly 117 to move the upper structure 110 by the second pitch angle "I2". The second pitch angle "I2" is determined by the control module 204 based on the first signal.

Further, the upper structure 110 is moved by the actuator assembly 117 in the clockwise direction "C1" or the anti-clockwise direction "C2" by the second pitch angle "I2". Moreover, the control module 204 compares the second pitch angle "I2" with the predetermined threshold range of the second pitch angle "I2". Further, the control module 204 transmits the second signal to the actuator assembly 117 for moving the upper structure 110 such that the second pitch angle "I2" is within the predetermined threshold range of the second pitch angle "I2". Moreover, the first pitch angle "I1" or the second pitch angle "I2" is presented on the output module 206 of the machine 100 that is communicably coupled with the control module 204.

The system 200 and the method 600 described herein provide a simple, effective, and cost-efficient solution for automating the movement of the upper structure 110 of the machine 100. More particularly, the system 200 and the method 600 allow oscillation or movement of the upper structure 110 based on the inclination of the machine 100 so that the operator cabin 114 is disposed perpendicular to the non-inclined surface 148. Further, during drilling operations, the system 200 and the method 600 allow locking of the actuator assembly 117, thereby ensuring stability of the machine 100 during drilling operations.

The system 200 and the method 600 reduce manual intervention by automating the movement of the upper structure 110 thereby providing improved operator comfort while performing machine operations. It should be noted that the system 200 and the method 600 described herein allow the actuator assembly 117 to be dynamically controlled to move the upper structure 110 by the second pitch angle "I2" so that the operator cabin 114 is disposed in an upright orientation. Thus, the system 200 and the method 600 ensure that the operator is comfortably seated within the operator cabin 114 in an upright manner even when the machine 100 operates on rough terrains or inclined surfaces.

Additionally, the control module 204 is designed to swiftly execute the movement of the upper structure 110 so that the operator is not subjected to sudden jerks or discomfort during the movement of the upper structure 110. Thus, the system 200 and the method 600 described herein adhere to machine compliance regulations by further ensuring operator comfort. The system 200 and the method 600 employ easily available components on the machine 100, such as the control module 204 and the sensor module 202, which in turn reduces complexity and costs. The system 200 and the method 600 may be retrofitted on any machine 100 with limited modifications, in turn, providing flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A machine operating on a work surface, the machine comprising:

a boom member;

a feed assembly movably coupled to the boom member;

a work device coupled at a distal portion of the feed assembly;

a movable carrier coupled to the boom member, the movable carrier including a lower structure and an upper structure movably coupled with the lower structure, the upper structure is configured to pitch, roll, and yaw relative to the lower structure;

an actuator assembly adapted to move the upper structure relative to the lower structure;

a sensor module mounted on the machine, wherein the sensor module is configured to generate a first signal indicative of a first pitch angle of the machine relative to a non-inclined surface; and a control module communicably coupled to the sensor module and the actuator assembly, wherein the control module is configured to:

receive the first signal indicative of the first pitch angle of the machine from the sensor module;

generate a second signal for controlling a movement of the actuator assembly based on the first signal; and transmit the second signal to the actuator assembly in order to move the upper structure by a second pitch angle, such that a plane defined by an operator cabin of the machine is substantially parallel to the non-inclined surface, wherein the second pitch angle is opposite in direction to the first pitch angle.

2. The machine of claim 1, wherein the control module is configured to determine the second pitch angle based on the first signal, and wherein the actuator assembly is adapted to move the upper structure by the second pitch angle.

3. The machine of claim 2, wherein the actuator assembly is adapted to move the upper structure in at least one of a clockwise direction and an anti-clockwise direction.

4. The machine of claim 1, wherein the second pitch angle is equal in magnitude to the first pitch angle.

5. The machine of claim 1, wherein the control module is further configured to:

compare the second pitch angle with a predetermined threshold range of the second pitch angle; and transmit the second signal to the actuator assembly for moving the upper structure such that the second pitch angle is within the predetermined threshold range of the second pitch angle.

6. The machine of claim 1 further comprising an output module communicably coupled with the control module, wherein the output module is configured to present at least one of the first pitch angle and the second pitch angle thereon.

7. The machine of claim 1, wherein the actuator assembly includes at least one first actuator mounted at a front end of the movable carrier and at least one second actuator mounted at a rear end of the movable carrier.

8. A method of moving an upper structure of a machine operating on a work surface, wherein the machine includes a lower structure and an actuator assembly adapted to move the upper structure relative to the lower structure, the method comprising:

generating a first signal, by a sensor module mounted on the machine, indicative of a first pitch angle of the machine relative to a non-inclined surface;

receiving, by a control module associated with the machine, the first signal from the sensor module;

generating, by the control module, a second signal for controlling a movement of the actuator assembly based on the first signal; and transmitting, by the control module, the second signal to the actuator assembly in order to move the upper structure by a second pitch angle, such that a plane defined by an operator cabin of the machine is substantially parallel to the non-inclined surface, wherein the second pitch angle is opposite in direction to the first pitch angle, wherein the upper structure is movably coupled to the lower structure and the upper structure is configured to pitch, roll, and yaw relative to the lower structure.

9. The method of claim 8 further comprising:

controlling the movement of the actuator assembly to move the upper structure by the second pitch angle, wherein the second pitch angle is determined by the control module based on the first signal.

10. The method of claim 9 further comprising moving the upper structure, by the actuator assembly, in at least one of a clockwise direction and an anti-clockwise direction.

11. The method of claim 8 further comprising:

comparing, by the control module, the second pitch angle with a predetermined threshold range of the second pitch angle; and transmitting the second signal to the actuator assembly for moving the upper structure such that the second pitch angle is within the predetermined threshold range of the second pitch angle.

12. The method of claim 8 further comprising:

presenting at least one of the first pitch angle and the second pitch angle on an output module of the machine that is communicably coupled with the control module.

13. A computer program comprising:

a program code means configured to cause a machine operating on a work surface to execute method steps of:

generating a first signal, by a sensor module mounted on the machine, indicative of a first pitch angle of the machine relative to a non-inclined surface;

receiving, by a control module associated with the machine, the first signal from the sensor module;

generating, by the control module, a second signal for controlling a movement of an actuator assembly of the machine based on the first signal, wherein the actuator assembly is adapted to move an upper structure of the machine relative to a lower structure of the machine, wherein the upper structure is movably coupled to the lower structure and the upper structure is configured to pitch, roll, and yaw relative to the lower structure; and transmitting, by the control module, the second signal to the actuator assembly in order to move the upper structure by a second pitch angle, such that a plane defined by an operator cabin of the machine is substantially parallel to the non-inclined surface, wherein the second pitch angle is opposite in direction to the first pitch angle.

14. The computer program of claim 13, wherein the program code means is configured to cause the machine operating on the work surface to execute method steps of:

controlling the movement of the actuator assembly to move the upper structure by the second pitch angle, wherein the second pitch angle is determined by the control module based on the first signal.

15. The computer program of claim 14, wherein the program code means is configured to cause the machine operating on the work surface to execute method steps of:

moving the upper structure, by the actuator assembly, in at least one of a clockwise direction and an anti-clockwise direction.

16. The computer program of claim 13, wherein the program code means is configured to cause the machine operating on the work surface to execute method steps of:

comparing, by the control module, the second pitch angle with a predetermined threshold range of the second pitch angle; and transmitting the second signal to the actuator assembly for moving the upper structure such that the second pitch angle is within the predetermined threshold range of the second pitch angle.

17. The computer program of claim 13, wherein the program code means is configured to cause the machine operating on the work surface to execute method steps of:

presenting the first pitch angle and the second pitch angle on an output module of the machine that is communicably coupled with the control module.

18. The machine of claim 1, wherein the sensor module includes a depth sensor mounted on the machine configured to generate the depth signals indicative of a depth of penetration of one or more pipes into the work surface.

19. The method of claim 8 further comprising mounting a depth sensor on the machine, such that the depth sensor is configured to generate the depth signals indicative of a depth of penetration of one or more pipes into the work surface.

20. The computer program of claim 13, wherein the program code means is configured to cause the machine operating on the work surface to execute method steps of:

mounting a depth sensor on the machine, such that the depth sensor is configured to generate the depth signals indicative of a depth of penetration of one or more pipes into the work surface.

* * * * *